US006883414B2

(12) United States Patent
Lowery et al.

(10) Patent No.: US 6,883,414 B2
(45) Date of Patent: Apr. 26, 2005

(54) MINE EXCAVATION METHOD AND APPARATUS

(75) Inventors: Brett R Lowery, Farnborough (GB); Thomas J Packard, Salisbury (GB)

(73) Assignee: Qinetiq Limited, Farnborough (GB)

( * ) Notice: Subject to any disclaimer, the term of this patent is extended or adjusted under 35 U.S.C. 154(b) by 0 days.

(21) Appl. No.: 10/467,620

(22) PCT Filed: Feb. 4, 2002

(86) PCT No.: PCT/GB02/00485

§ 371 (c)(1),
(2), (4) Date: Aug. 8, 2003

(87) PCT Pub. No.: WO02/066919

PCT Pub. Date: Aug. 29, 2002

(65) Prior Publication Data

US 2004/0069133 A1 Apr. 15, 2004

(30) Foreign Application Priority Data

Feb. 16, 2001 (GB) ..... 0103844

(51) Int. Cl.[7] ..... B63G 7/02
(52) U.S. Cl. ..... 89/1.13; 102/403
(58) Field of Search ..... 89/1.13; 102/402, 102/403

(56) References Cited

U.S. PATENT DOCUMENTS 2,806,442 A * 9/1957 Temple ..... 114/221 A
3,111,927 A * 11/1963 Temple et al. ..... 114/221 R
3,326,172 A * 6/1967 Kish ..... 114/221 R
3,844,244 A * 10/1974 White ..... 114/221 A
4,128,071 A * 12/1978 Layman et al. ..... 114/221 A
5,448,936 A * 9/1995 Turner ..... 89/1.13
5,661,258 A * 8/1997 Garcia et al. ..... 102/402
5,771,833 A * 6/1998 Hasse ..... 114/221 A
5,988,038 A * 11/1999 Feintuch ..... 89/1.13
6,032,567 A * 3/2000 Jones et al. ..... 89/1.13
6,546,838 B1 * 4/2003 Zavitsanos et al. ..... 89/1.13
6,679,176 B1 * 1/2004 Zavitsanos et al. ..... 102/364
2002/0096039 A1 * 7/2002 Anderson ..... 89/1.13

FOREIGN PATENT DOCUMENTS

| | | |
|---|---|---|
| DE | 199 44 415 A | 4/2001 |
| EP | 0 916 921 A | 5/1999 |
| FR | 2 757 622 A | 6/1998 |
| GB | 2 321 880 A | 8/1998 |

* cited by examiner

*Primary Examiner*—Peter M. Poon
*Assistant Examiner*—Troy Chambers
(74) *Attorney, Agent, or Firm*—Nixon & Vanderhye P.C.

(57) ABSTRACT

This invention relates to the filed of land mines and in particular to devices and techniques for neutralising and/or retrieving land mines. Existing mine retrieval/neutralisation techniques includes mechanical excavation or shaped charge attack and such techniques are either susceptible to blast damage in the event of inadvertent mine explosion or can produce ambiguous results (i.e. and operator can be unsure as to whether a mine has been successfully attacked or a non-mine target has been attacked in error). The present invention provides a mine excavation technique that involves excavation of the mine by means of an explosive charge.

13 Claims, 2 Drawing Sheets

MINE EXCAVATION METHOD AND APPARATUS

This application is the US national phase of international application PCT/GB02/00485 filed 4 Feb. 2002, which designated the US.

This invention relates to the field of land mines and in particular to devices and techniques for excavating mines.

Land mines can be buried or surface laid. A surface laid mine does not present a major problem to an Explosives Ordnance Disposal (EOD) technician since it can be attacked and neutralised from a safe stand-off distance, e.g. by means of a projectile, pyrotechnic torch or other suitable means. Buried mines, however, present more of a problem.

Anti-personnel mines are generally fairly close to the surface but anti-tank mines can be up to 300 mm from the surface. Current techniques for neutralising buried mines include mechanical excavation or shaped charge attack.

Mechanical excavators simply dig mines out of the ground ready for subsequent disposal or attack. Such systems are vulnerable to blast damage in the event of an inadvertent explosion.

Shaped charge attack neutralisation techniques aim to initiate mines by imparting energy into the explosive component of the mine. If no reaction occurs then the EOD technician does not know whether a non-mine target has been attacked in error, the mine has been missed or insufficient energy has been imparted to the explosive contents of the mine.

It is therefore an object of the present invention to provide a method of mine neutralisation/retrieval (and device therefor) that substantially mitigates or overcomes the above mentioned problems.

Accordingly the invention provides a method of excavating a buried mine comprising the steps of:

i) locating a mine to be retrieved;

ii) placing a low explosive charge into the ground in proximity to the mine iii) detonating the explosive charge in order to excavate the mine from the ground.

Correspondingly the invention provides a mine excavation device comprising an explosively tipped projectile, detonation means for detonating the explosively tipped projectile and propelling means arranged in use to be capable of propelling the projectile into the ground and into proximity with a mine to be retrieved wherein the explosively tipped projectile is arranged such that in use detonation of the explosive causes the mine to be excavated from the ground The invention comprises the use of a small explosive charge to excavate the mine from the ground. A small explosive charge (in the region of 50–250 g of a suitable explosive, such as PE4, a commercially available explosive) is placed into proximity of the mine to be excavated) for example, the charge is placed beneath and slightly to one side of the mine). Upon detonation of the small explosive charge the mine is flipped out of the ground along a radial line that bisects the mine and the explosive charge (Note: many modern mines are blast hardened/resistant and so the detonation of a small amount of low explosive nearby is unlikely to activate the mine). Once the mine is on the surface it can be more easily neutralised by an EOD technician by conventional means as described above.

Conveniently, if the mine is buried in sandy soil a net can be placed over the mine in order to catch the mine after detonation of the small explosive charge. The use of a net in this way assists location of the mine after it has been removed from the surface.

The excavating charge can be placed in a number of ways. Conveniently, a simple boring tool can be used so that the charge can be placed manually. Alternative ways of placing the charge include:

i) introducing the charge into the ground by means of a gun and projectile arrangement;

ii) incorporating the excavating charge into a spike which is mounted on a base plate. In this embodiment a sheet explosive can be used to propel the base plate and explosively tipped spike into the ground;

iii) use of a hydraulic arm to "inject" the charge into the ground.

If a gun/projectile delivery method is used then the projectile can conveniently include arrestor arms that deploy in flight and which stop the projectile when it has reached the correct mine excavating depth.

If a hydraulic arm is used then conveniently a disposable spacing element can be used to space the charge from the hydraulic mechanism in order to protect the hydraulics in the event of inadvertent mine activation. Furthermore, a crumple zone could also conveniently be incorporated into the hydraulic arm to protect against high shock loads.

An excavating charge has a large effective area of ground coverage (approximately 1.2 m in diameter) and so this invention is particularly useful when the detection location accuracy and depth of the buried mine is approximate.

Embodiments of the present invention will now be described, by way of example, with reference to the accompanying drawings, wherein FIGS. 1–3 show a mine neutralisation device according to the gun/projectile embodiment of the invention.

Figure 1:
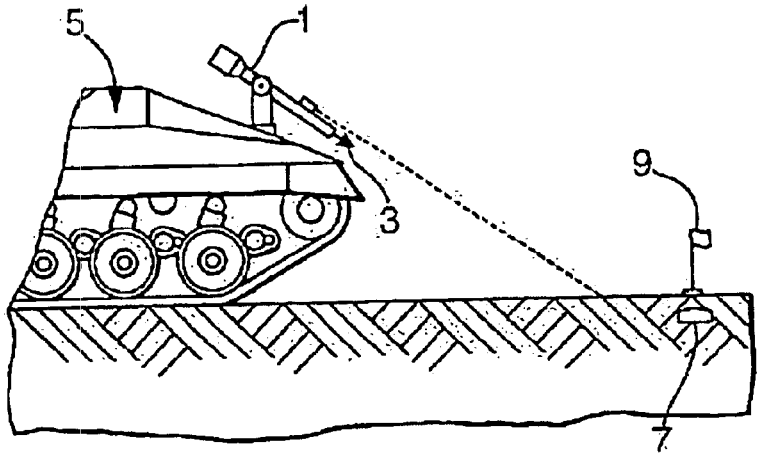

In FIG. 1, a gun 1 and projectile 3 are carried upon a vehicle 5. A mine 7 to be retrieved has already been identified and its position is marked by the flag 9.

Figure 2:
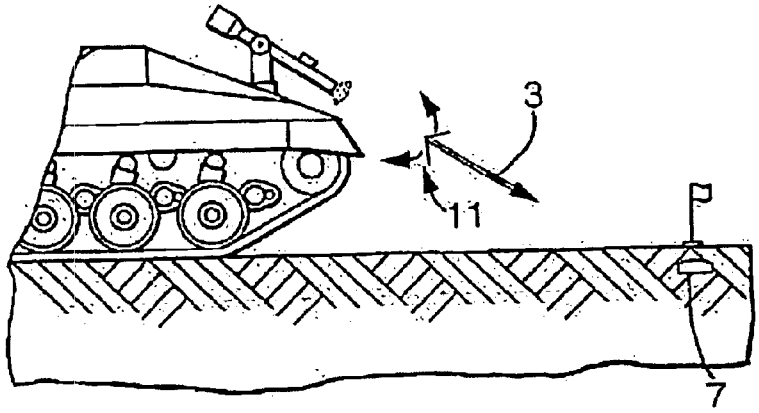

FIG. 2 shows the projectile 3 in flight. The arrestor arms 11 are in the process of deploying. A small explosive charge is situated in the front portion of the projectile.

Figure 3:
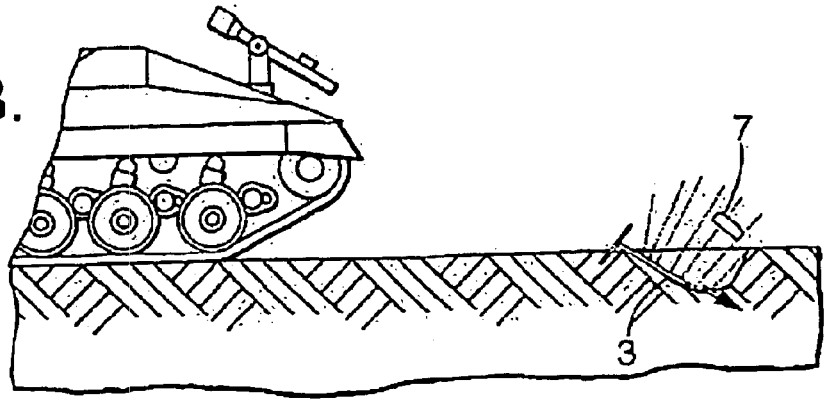

In FIG. 3 the projectile 3 has penetrated the ground such that its front portion lies beneath and slightly to one side of the mine 7. Upon detonation the explosive charge flips the mine out from the ground.

In tests between 50 g and 250 g of PE4 explosive was placed beneath the mine and depending on the relative position of the charge and mine and the soil conditions, the mine was flipped out in a radial direction bisecting the centre of the mine and the underground charge a distance of between 0.5 and 70 metres.

Figure 4:
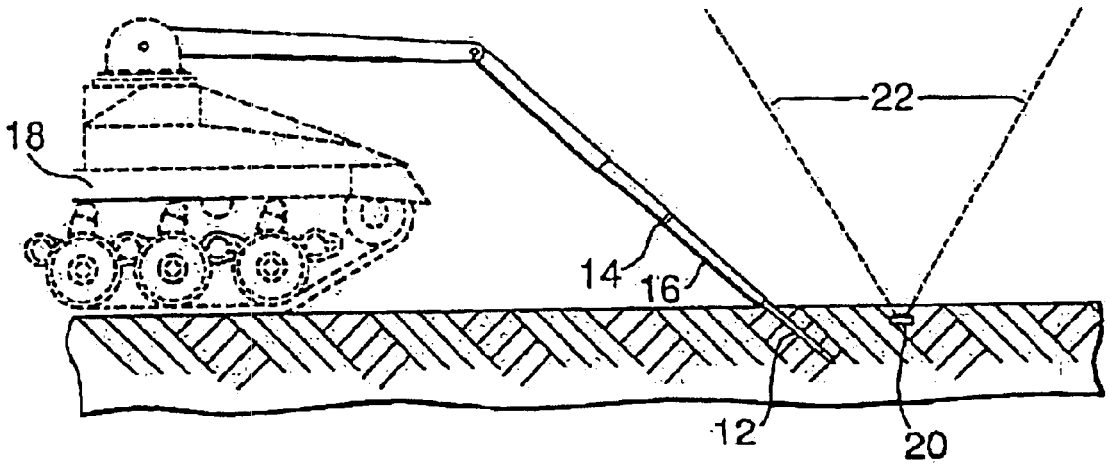
FIG. 4 shows a mine neutralisation device according to the hydraulic embodiment of the invention.

FIG. 4 shows the mine retrieval device according to the hydraulic embodiment of the invention. In this case an explosively tipped member 12 is carried on the end of a hydraulic arm 14. A sacrificial spacing tube 16 separates the member 12 from the hydraulic arm 14 in order to help prevent possible blast damage. The deice in this case is mounted upon a tank 18 although a robot or other delivery means could be used.

In use the mine retrieval device is "injected" by the hydraulic system until the explosive carried upon member 12 is beneath and to one side of the mine 20 to be retrieved. The mine 20 will generally have a blast zone 22 as depicted. The stand-off provided by the spacing tube 16 and hydraulic arm 14 and the angle of delivery, therefore increases the blast protection of the total system.

Once the device has been placed beneath the mine the hydraulic arm is retracted (and subsequently reloaded with another explosively tipped member 12) and the explosive is initiated. The mine will be flipped out of the ground for subsequent disposal.

Figure 5:
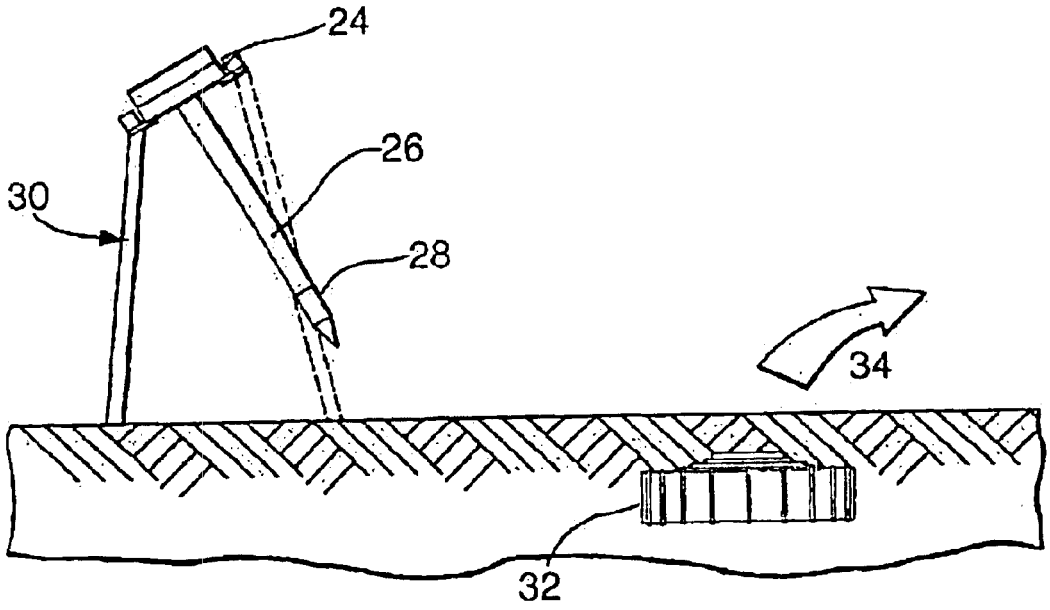
FIG. 5 shows a mine neutralisation device according to the spike/base plate embodiment of the invention.

In FIG. 5 a base plate 24 supports a projectile 26 which is tipped with explosive 28. The base plate is supported by a structure 30.

In use the device is placed in the general location of a mine 32. Upon detonation of an explosive sheet (not shown) the projectile is forced into the ground. The explosive tip 30 is detonated by a delayed action fuze system (not shown) once full penetration has occurred. This allows the blast to act under the base of the mine 32, excavating it from the ground (in the direction indicated by arrow 34).

What is claimed is:

1. A method of excavating a buried mine comprising the following steps:

(i) locating a mine to be retrieved;

(ii) placing an explosive charge into the ground in proximity to the mine (iii) detonating the explosive charge in order to excavate the mine from the ground.

2. A method of excavating a buried mine according to claim 1 comprising the further step of placing a net on the surface of the ground above the mine such that following detonation of the explosive charge the mine is caught in the net.

3. A mine excavation device for performing the method according to claim 1, said device comprising:

an explosively tipped projectile;

detonation means for detonating the explosively tipped projectile; and propelling means arranged for propelling the projectile into the ground and into proximity with a mine to be retrieved wherein detonation of the explosively tipped projectile causes the mine to be excavated from the ground.

4. A mine excavation device according to claim 3 wherein the propelling means comprises a gun.

5. A mine excavation device according to claim 4 wherein the projectile further comprises arrestor arms arranged in use to be capable of arresting the forward motion of the projectile once it has reached its mining depth.

6. A mine excavation device according to claim 3 wherein the propelling means is a hydraulic arm arranged in use to push the projectile into the ground.

7. A mine excavation device according to claim 3 wherein the projectile is supported by a base plate and the propelling means is capable in use of propelling the base plate and the projectile into the ground in proximity to the mine to be excavated.

8. A mine excavation device according to claim 7 wherein the propelling means is a sheet explosive.

9. A method according to claim 1, wherein the placing step includes the step of locating said explosive charge in a position beneath that of the mine.

10. A method according to claim 1, wherein the placing step includes the step of locating said explosive charge in a position to one side of said mine.

11. A mine excavation device according to claim 3, wherein the detonation means for detonating the explosively tipped projectile comprises a delayed action fuze.

12. A method of excavating a buried mine according to claim 1, wherein the placing step includes the step of placing a small explosive charge into the ground in proximity to the mine.

13. A method of excavating a buried mine according to claim 1, wherein the placing step includes the step of placing a low explosive charge into the ground in proximity to the mine.

* * * * *